US005700170A

United States Patent [19]

Mataya

[11] Patent Number: 5,700,170

[45] Date of Patent: Dec. 23, 1997

[54] VARIABLE DIAMETER JET PROPULSION UNIT

[76] Inventor: Robert F. Mataya, 614 Coles Loop, Post Falls, Id. 83854

[21] Appl. No.: 568,150

[22] Filed: Dec. 8, 1995

[51] Int. Cl.[6] ..... B63H 11/103

[52] U.S. Cl. ..... 440/47

[58] Field of Search ..... 440/38, 47; 239/546; 60/235

[56] References Cited

U.S. PATENT DOCUMENTS

| | | | |
|---|---|---|---|
| 3,620,019 | 11/1971 | Munte | 60/221 |
| 3,942,463 | 3/1976 | Johnson, Jr. et al. | 440/47 |
| 4,027,407 | 6/1977 | Kiss | 37/61 |
| 4,595,344 | 6/1986 | Briley | 239/546 |
| 5,123,867 | 6/1992 | Broinowski | 440/42 |
| 5,224,425 | 7/1993 | Tasaki | 440/47 |
| 5,295,645 | 3/1994 | Rozmus | 239/546 |
| 5,338,234 | 8/1994 | Nanami | 440/38 |
| 5,542,863 | 8/1996 | Brian | 440/47 |

*Primary Examiner*—Stephen Avila
*Attorney, Agent, or Firm*—David S. Thompson

[57] ABSTRACT

An apparatus is disclosed to alter the diameter of the nozzle of a jet boat, thereby allowing a user to maximize acceleration, top speed, fuel economy or other factors. The disclosed apparatus allows a user to adjust the nozzle diameter opening, while the boat is moving, by an elastic annular hydraulic bladder that reduces the cross sectional area of a cone formed by a plurality of cone plates. The apparatus is compatible with steering and trim adjustment devices, and is located rearward of them. The apparatus is also compatible with existing jet boat, and provides a bowl adapter that may be attached to the impeller bowl of an existing jet. A steering collar attaches to the bowl adapter by two vertical pins to allow rotation to the left and right. Two horizontal pins on the steering collar support a nozzle front lock plate in a manner that allows vertical trim adjustment. The nozzle cone plates are mounted in a hinged manner to the nozzle front lock plate and the nozzle housing support. A splines assembly forces the nozzle cone plates to act in a symmetrical manner, and bridges the gaps between adjacent nozzle cone plates when the nozzle is open, thereby preventing the bladder from entering the gaps. An elastic block biases the nozzle cone plates radially outwardly, and opens the nozzle when the hydraulic bladder is not engaged.

19 Claims, 9 Drawing Sheets

FIG. 15
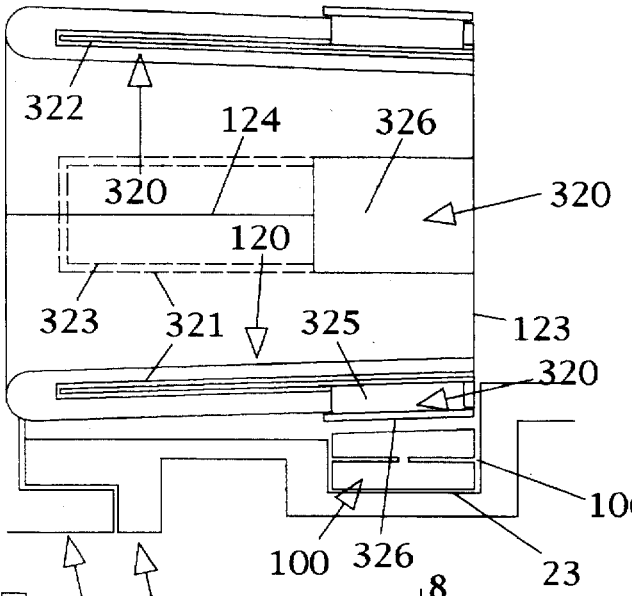
FIG. 16
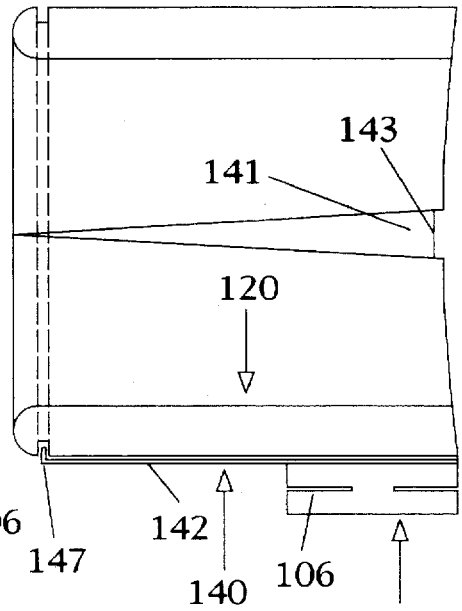
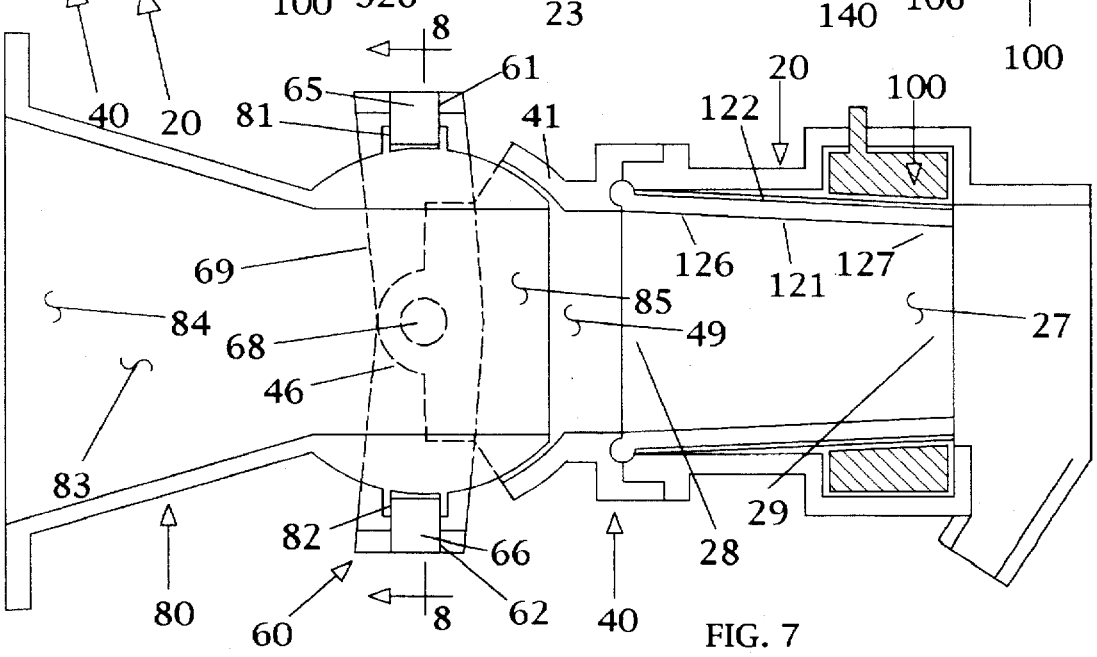
FIG. 7

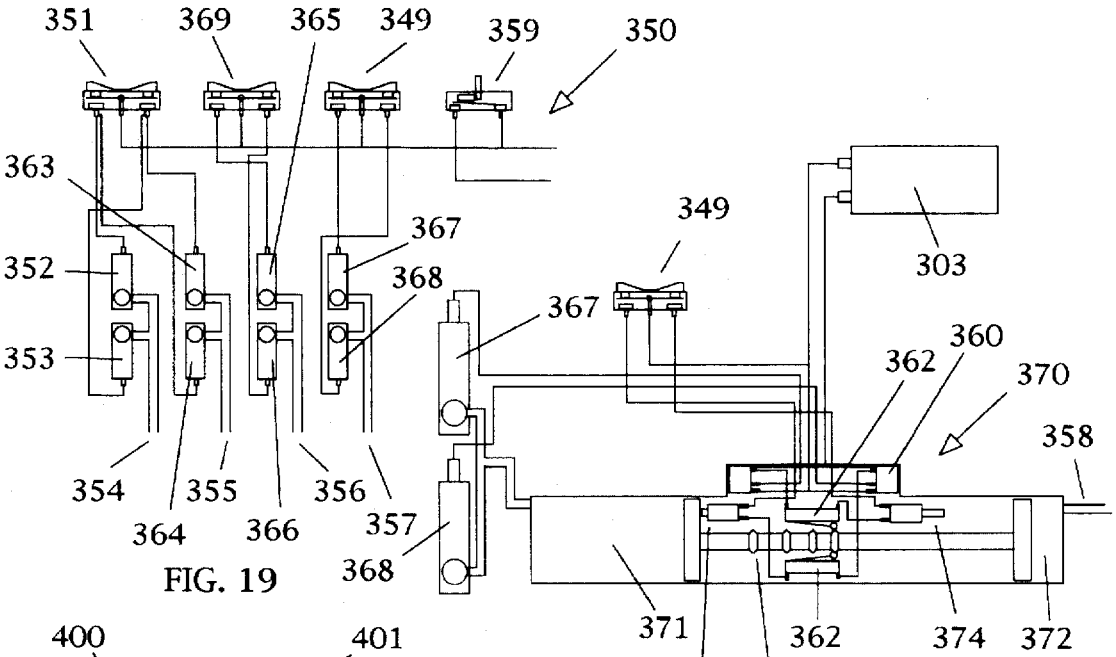
FIG. 19
FIG. 20
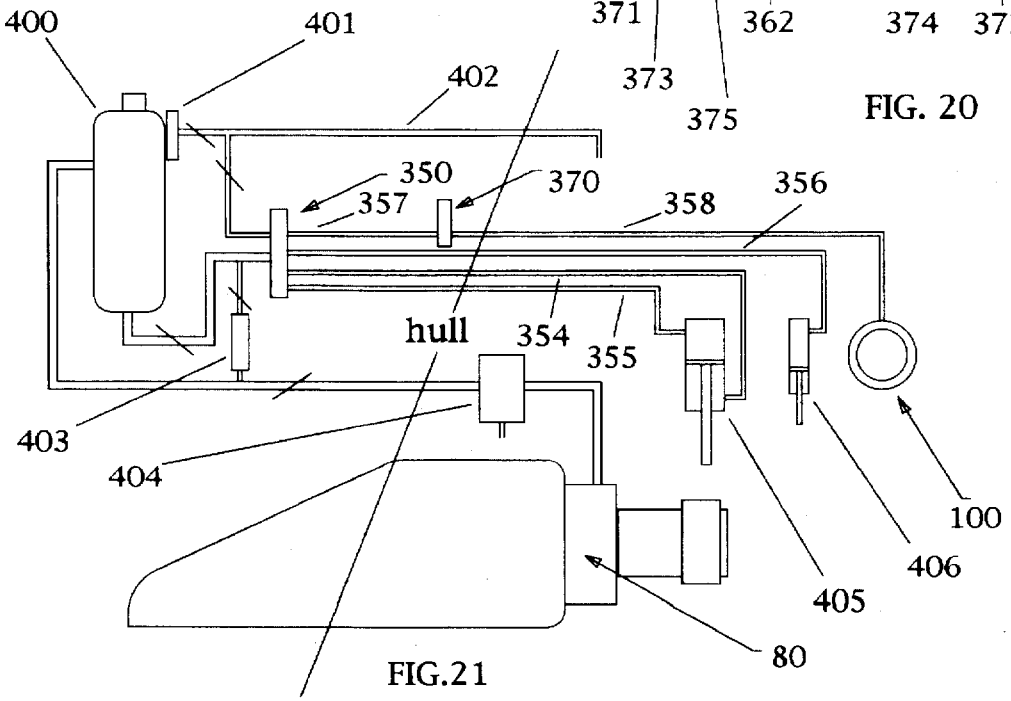
FIG.21

VARIABLE DIAMETER JET PROPULSION UNIT

CROSS-REFERENCES

There are no applications related to this application filed in this or any foreign country.

BACKGROUND

The popularity of jet propulsion systems in marine applications is due to a number of reasons, including the safety of not having an exposed propeller, the efficiency of an enclosed (shrouded) impeller, and the low water draft that is characteristic of such vessels. Despite the advantages of jet propulsion, problems still remain. For example, no single jet design maximizes engine output for greatest acceleration rate, highest fuel economy, and highest top speed. A jet nozzle having an opening of smaller cross-sectional area tends to allow a smaller volume of faster moving water to exit. This jet design would result in a higher top speed, but also would result in slower acceleration. In contrast, a jet nozzle having a larger cross-sectional area would allow a larger volume of slower moving water to exit. This jet design would result in a slower top speed, but in faster acceleration. An intermediate design would give optimum fuel economy at a given speed, yet would not result in top speed or fastest acceleration.

A number of solutions have been suggested to solve this problem, and to combine the advantages to all nozzle designs. One previous suggestion was to provide a plurality of rings that may be inserted and fastened in the aft end of a jet nozzle, each reducing the diameter by a different amount. In this manner, a user could select select a nozzle cross-sectional area consistent with the performance parameters desired. However, once mounted, the ring would be difficult and time-consuming to remove and replace.

Alternate solutions have involved the use of stream deforming structures to alter the flow speed and flow volume. However, these solutions have increased the friction of the water, and in doing so have decreased the output efficiency.

For the foregoing reasons, there is a need for an apparatus that can alter the cross-sectional area of a jet boat's nozzle while the boat is in motion. The apparatus must result in minimal increased friction, and must allow the user to maximize acceleration, top speed, or fuel efficiency.

SUMMARY

A preferred version of the variable diameter jet propulsion unit for a pleasure, commercial, or military marine craft of the present invention provides:

(a) A bowl adapter, attached to the impeller bowl of a jet boat's propulsion system. The bowl adapter provides a forward opening which attaches to the impeller bowl and a typically somewhat narrower rearward opening. The bowl adapter typically provides upper and lower pin holes about the rearward opening supporting upper and lower pins in a linear, vertical manner.

(b) A control collar, carried by the upper and lower pins provided by the rearward opening of the bowl adapter, in a manner that allows left-and-right pivoting motion in the horizontal plane. The control collar is annular or ring-like in structure, and has an inside diameter that is somewhat larger than the rearward opening of the bowl adapter. The control collar provides radially directed, co-linear left and right pins and pin holes.

(c) A nozzle front lock plate, pivotably carried by the left and right pins of the control collar. The nozzle front lock plate pivots about the left and right pins in an up-and-down motion in a vertical plane, to adjust the trim of the boat.

(d) A nozzle housing, rigidly attached to the nozzle front lock plate. The inside rear portion of the nozzle housing provides an annular bladder recess.

(e) Four nozzle cone plates, each plate pivotally locked into the nozzle housing and the nozzle front lock plate. The cone plates are infinitely adjustable between a fully open state, in which the cross-section of the opening in the nozzle is at its greatest area, and a fully closed state where the cross-sectional area of opening in the nozzle is at its least area.

(f) Structural means to provide for the symmetrical movement of the nozzle cone plates as they move between the open and closed state. In the preferred embodiment, each nozzle cone plate provides a spline cavity in each side edge. This allows a sheet-like spline to be carried between each two adjacent nozzle cone plates. A radially directed connector protrudes from the spline, between the side edges of adjacent nozzle cone plates, and carries a sheet-like spline shield which provides a covering between the adjacent nozzle cone plates which bridges the gap between the nozzle cone plates when they separate when in the open position, thus protecting the bladder.

In a second species typically used in lower powered applications, cone shield plates are mounted radially outwardly from the nozzle cone plates in a staggered manner. The cone shield plates provide the same functionality the splines of the preferred embodiment: they cause the nozzle cone plates to move in unison and they bridge the gap between adjacent nozzle cone plates when the nozzle is in the open position.

(g) An elastic annular bladder, carried between the annular bladder recess of the nozzle housing and in contact with the cone shield plates and the nozzle cone plates. When an hydraulic medium is pumped into the annular bladder, the bladder expands radially inwardly. The expansion forces the nozzle cone plates to form a cone of smaller diameter, eventually causing the edges of adjacent cone plates to come into contact. The cone shield plates or splines, as a result of their 45 degree offset with the cone plates, bridge the gaps between the nozzle cone plates and prevent the annular bladder from being caught between two nozzle cone plates.

(h) A source of hydraulic power attached to the annular bladder. In the preferred embodiment, the hydraulic power source is the boat's own impeller. High pressure water is typically removed from the bowl adapter, where the pressure is always greater than in the smaller diameter nozzle, and is used to inflate the annular bladder, thus closing the nozzle. Alternatively, the source of hydraulic power may be an hydraulic pump, driven by an electric motor controlled by "open" and "close" switches.

(i) An elastic block or other type of resilient spring device is associated with each nozzle cone plate, and biases the nozzle cone plates radially outwardly. Each elastic block is carried by an elastic block recess on the outside of the nozzle housing. A belt goes through each elastic block and is secured in the middle of each nozzle cone plate. In applications where cone shield plates are used, half-circle cut-outs on the side edge of each cone shield plate allows the cone shield plates to close about the bolt. When fluid is forced into the elastic annular bladder, the nozzle cone plates are forced radially inward, and the elastic blocks are therefore compressed. When fluid is removed from the elastic annular bladder, the elastic blocks resiliently return to their former shapes, pulling the nozzle cone plates radially outwardly.

It is therefore a primary advantage of the present invention to provide a novel hydraulically operated device to control the cross-sectional area of the jet propulsion nozzle so that the operator may maximize the output of the jet for more rapid acceleration, greater top speed, greater fuel economy, or other factors. The present invention is capable of being adapted for use where the power plant is a singe-cylinder two-cycle engine or a multi-cylinder four cycle engine.

Another advantage of the present invention is to provide a device to control the cross-sectional area of a jet boat's nozzle that is capable of being installed on existing jet boats, whether the boats are intended for pleasure, commercial, or military use.

A still further advantage of the present invention is to provide a device to control the cross-sectional area of a jet boat's nozzle while showing a reduction in internal flow resistance when compared to nozzles which require steering and trimming devices downstream or multiple articulated sections to accomplish steering and trim functions.

A still further advantage of the present invention is to provide a device to control the cross-sectional area of a jet boat's nozzle that is compatible with, and downstream from, any steering and trim mechanisms. The nozzle of the present invention does not depend on rigid mechanical linkages that would interfere with movement of the nozzle in the vertical or lateral planes.

A still further advantage of the present invention is to provide a device to control the cross-sectional area of a jet boat's nozzle that is external to the boat's pumping unit for ease of maintenance.

A still further advantage of the present invention is to provide a device that is able to use water and pressure provided by the jet pump unit to activate the nozzle diameter size adjusting, trim adjusting, and reverse mechanisms.

DRAWINGS

These and other features, aspects, and advantages of the present invention will become better understood with regard to the following description, appended claims, and accompanying drawings where:

FIG. 7 is a cross-sectional side view of the nozzle of FIG. 6;

FIG. 15 is a lengthwise cross-sectional view of the preferred version of the invention, having a locking splines assembly, showing the elastic annular bladder in an inflated state;

FIG. 16 is a lengthwise cross-sectional view of a version of the invention having a cone shield plates having an alternative locking means, showing the elastic annular bladder in a deflated state, and having the nozzle housing removed for clarity;

FIG. 19 is a diagrammatic view of the control valves controlling the trim, reverse bucket, and the elastic annular bladder;

FIG. 20 is a diagrammatic view of a mechanical nozzle diameter setting apparatus;

FIG. 21 is a diagrammatic view of the preferred version of the invention, showing how the elastic annular bladder controlling the nozzle is controlled;

DESCRIPTION

Figure 1:
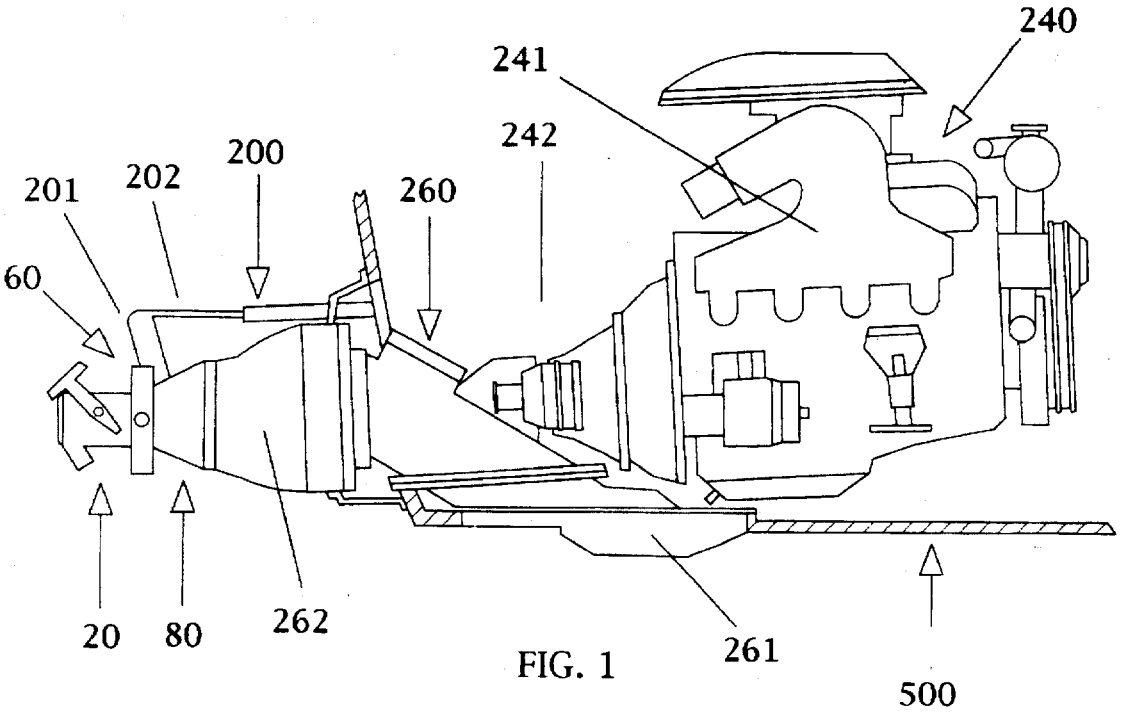
FIG. 1 is a somewhat diagrammatic side view of the typical jet propelled boat's engine and jet propulsion unit showing a version of the invention attached to the impeller bowl of the propulsion unit.

Referring in particular to FIGS. 1 and 7, a variable diameter jet propulsion unit constructed in accordance with the principles of the invention is seen. A typical known type of jet boat 500 provides a propulsion assembly 240 driving a pump assembly 260 having an impeller bowl 262. The variable diameter jet propulsion unit of the invention provides a bowl adapter 80 attached to the impeller bowl 262. A control collar 60, carried by the bowl adapter 80, pivots about two axes for steering and trim. A nozzle front lock plate 40 and a nozzle housing 20 pivotally carry four nozzle cone plates 120 in a pivoting manner. Heavy-duty applications also provide a splines locking assembly 320, with splines 322 connecting the edges of adjacent nozzle cone plates, to force the nozzle cone plates to act in a symmetrical manner. Light-duty applications of the invention provide cone shield plates 140 mounted in a staggered manner immediately radially outwardly from the nozzle cone plates to perform the same functionality. An elastic annular bladder 100, carried between the nozzle housing 20 and the cones plates 120 may be hydraulically expanded to reduce the diameter of the axial water passage between the cone plates, thus restricting the flow of water through the nozzle to increase the water speed. When the hydraulic pressure is released, water pressure and a biasing force from an elastic block 160 returns the nozzle cone plates 120 to the open position, allowing a greater quantity of slower moving water to exit from the nozzle.

As seen in FIG. 1, a jet boat 500 of the type modified by the instant invention provides a hull 501 and transom 502. A propulsion assembly 240 typically provides an engine 241 having a drive shaft 242. The engine 241 is typically a two or four-stroke gasoline engine with multiple cylinders, however an alternative propulsion system may be diesel fueled or turbine powered, or have a structure consistent with the design parameters of military, commercial or pleasure boat construction.

The drive shaft 242 drives a pump assembly 260 which provides a pump 263 having an impeller bowl 262 which draws water from an intake duct 261 in the lower portion of the hull 501.

The boat is steered when under power by means of a steering assembly 200. A tiller arm 201 is carried by control collar 60 and rotates the jet nozzle about a vertical axis in the horizontal plane. The tiller arm 201 is controlled by a steering actuating mechanism 202. Steering actuating mechanism 202 is typically a push/pull cable, an hydraulic cylinder, or a cable and pulley system, but could be other structure with sufficient mechanical leverage to allow for ease of lateral pivoting of the steering control.

Similarly, the trim may be adjusted in a vertical plane about a horizontal axis by means a trim assembly 220. A trim arm 221 is carried by the control collar 60, and provides leverage for a trim actuating mechanism 222. The trim actuating mechanism 222 is usually an hydraulic cylinder, but can be a push/pull cable in smaller applications.

A reverse bucket assembly 180 allows the user to reverse the boat, and is compatible with the variable diameter jet propulsion unit of the invention. The reverse bucket assembly functions to prevent water from exiting the end of the nozzle, thereby forcing the water to exit through reverse passage 26 in nozzle housing 20, as seen in FIG. 7. As seen in FIG. 1, the reverse bucket is activated by a lever arm 181 which rotates about lever arm pivot 182 to move bucket body 183 between a first non-operational position and a second, operational position blocking the exit of the nozzle. An intermediate setting tends to keep the boat in is current position. The lever arm 181 is operated by means of an actuator 184, which typically employs an hydraulic cylinder in a larger vessel, but may be push/pull cable operated in a smaller vessel.

As seen in FIG. 19, the reverse hydraulic control line 356 is controlled by an electrical switch controlling solenoid valves which regulates water from the accumulator 400. A single acting cylinder 406 with a spring loaded return mechanism (not shown) having a rod 184 actually moves the bucket. A normally closed pressurizing solenoid 365 and a normally open bleeding solenoid 366 allows the user to apply pressure to cylinder 184 or to allow the pressure to escape through bleed line 402. Solenoids 365 and 366 are wired so that only one may be operated at any given time.

Figure 2:
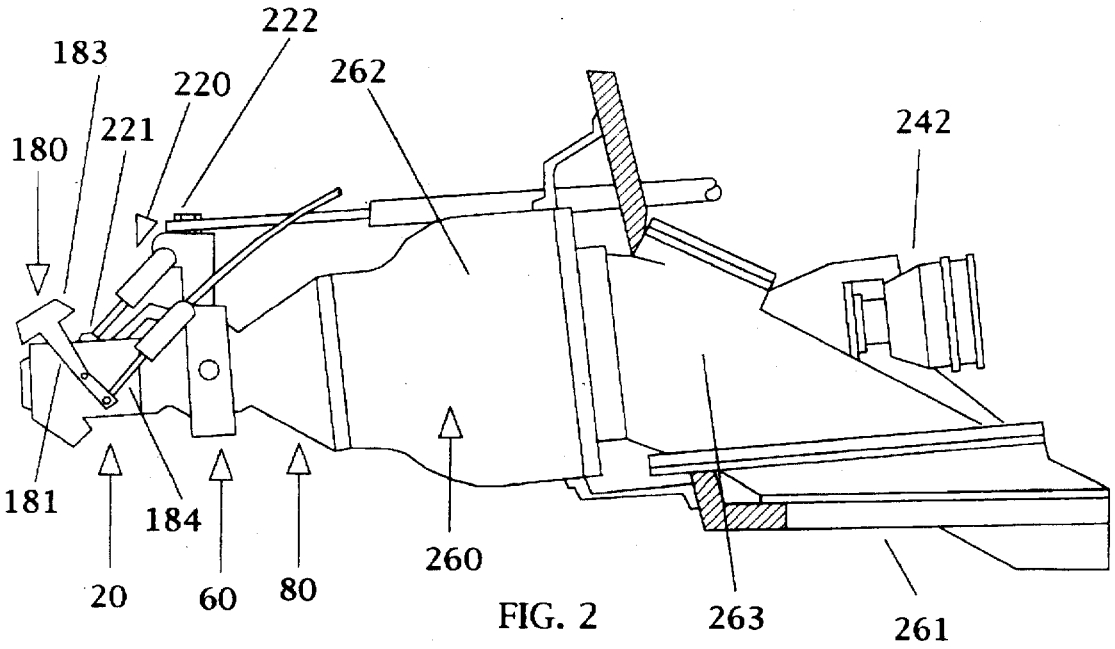
FIG. 2 is a somewhat enlarged view of the pumping unit of FIG. 1, showing a version of the invention in greater detail.
Figure 6:
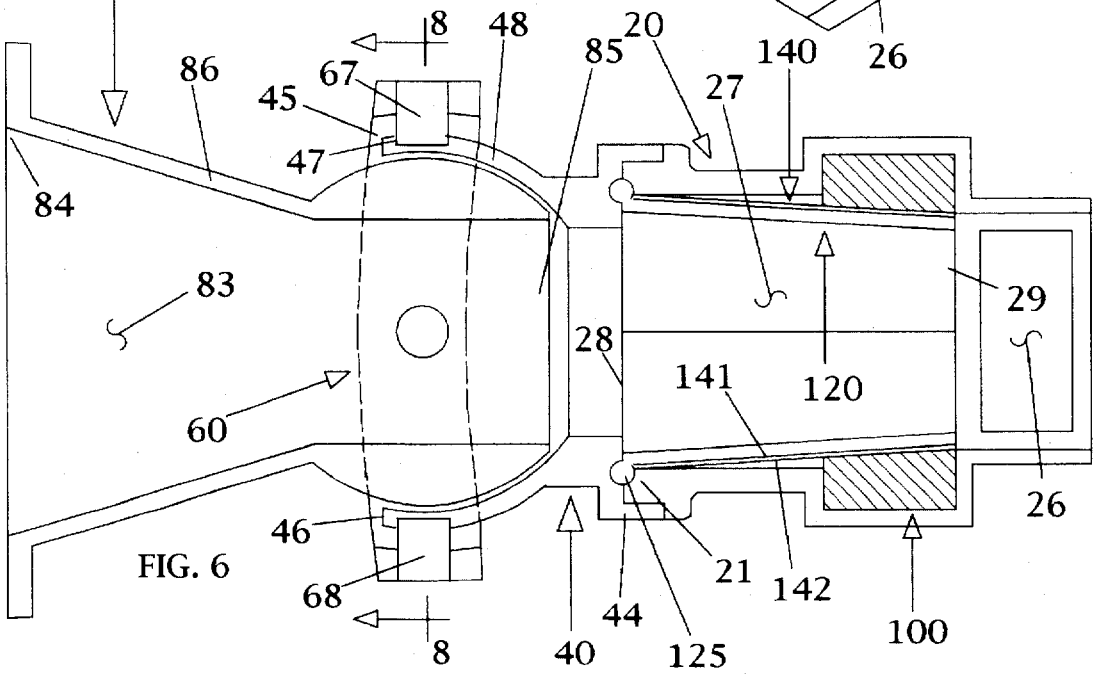
FIG. 6 is a cross-sectional top view of a second species of the nozzle of the invention having cone shield plates and having a bowl adapter having upper and lower pin holes, with the nozzle cone plates in the closed position.
Figure 17:
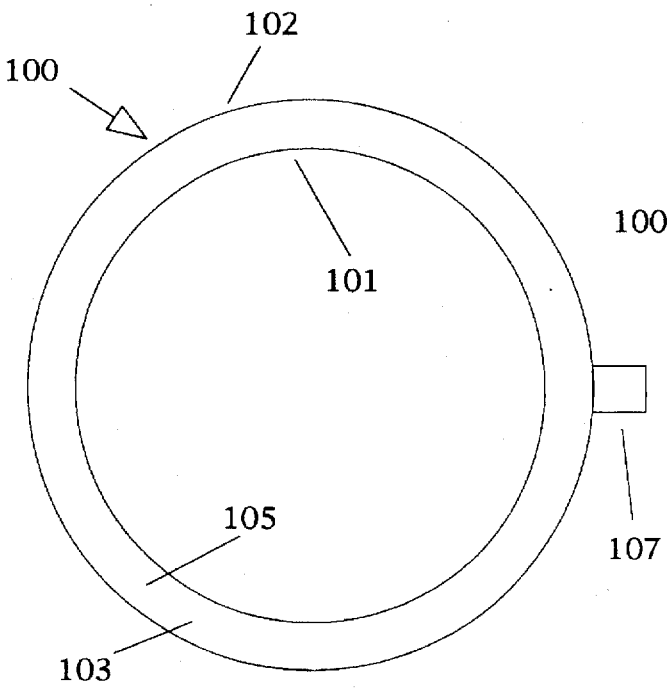
FIG. 17 is an end view of the elastic annular bladder.
Figure 18:
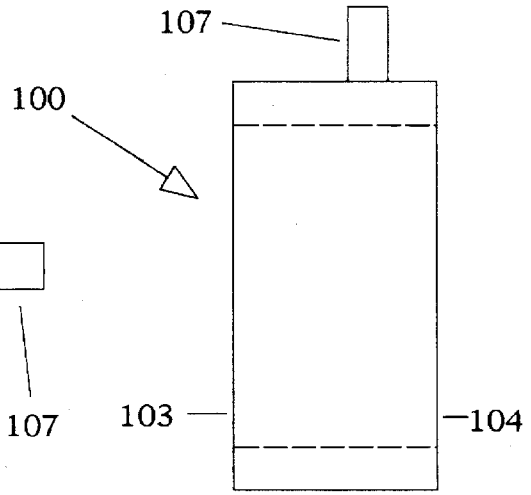
FIG. 18 is a side view of the elastic annular bladder.
Figure 8:
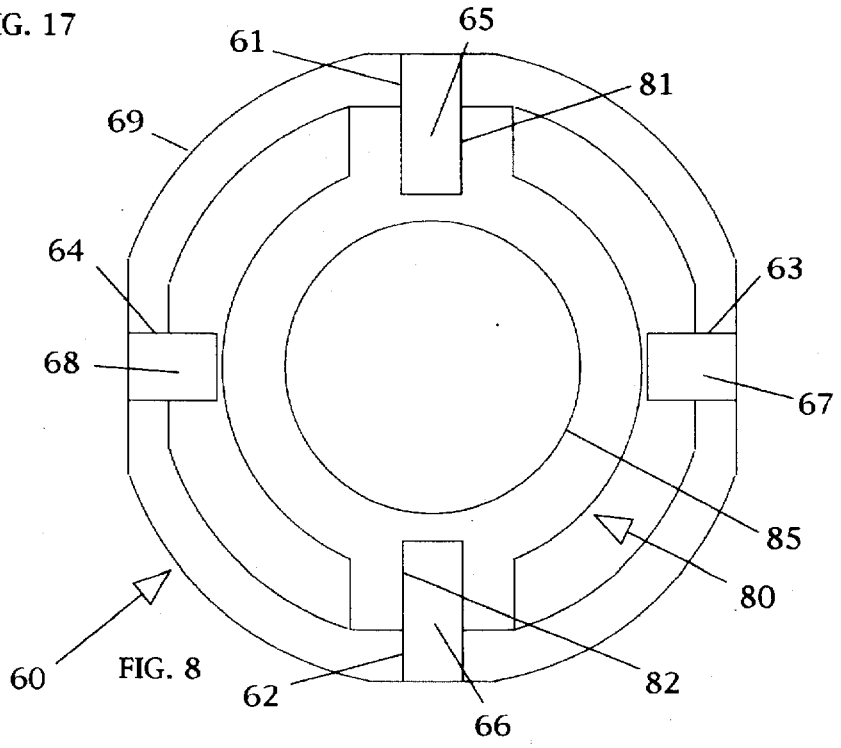
FIG. 8 is a cross-sectional view of the control collar, showing its attachment to the bowl adapter, along the 8—8 lines of FIG. 7.
Figure 11:
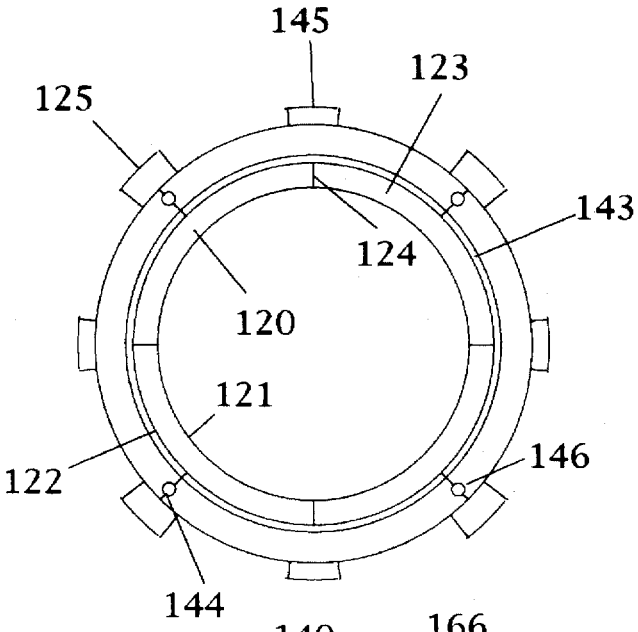
FIG. 11 is a forward looking view of the rear of the nozzle of the species of the nozzle of the invention seen in FIG. 6 with the nozzle cone plates and cone shield plates in the closed position, showing the cylindrical tabs of the nozzle cone plates and cone shield plates, but with the nozzle housing and nozzle front lock plate removed for clarity.

As seen in particular in FIGS. 2, 6, and 8, a bowl adapter 80 is attached to the impeller bowl 262 of a jet boat's jet propulsion unit. The bowl adapter 80 provides an interior channel 83 having smoothly tapered sides through which water from the impeller bowl 262 may flow. The bowl adapter 80 allows the variable diameter jet propulsion unit of the invention to be attached to an existing jet boat.

Figure 23:
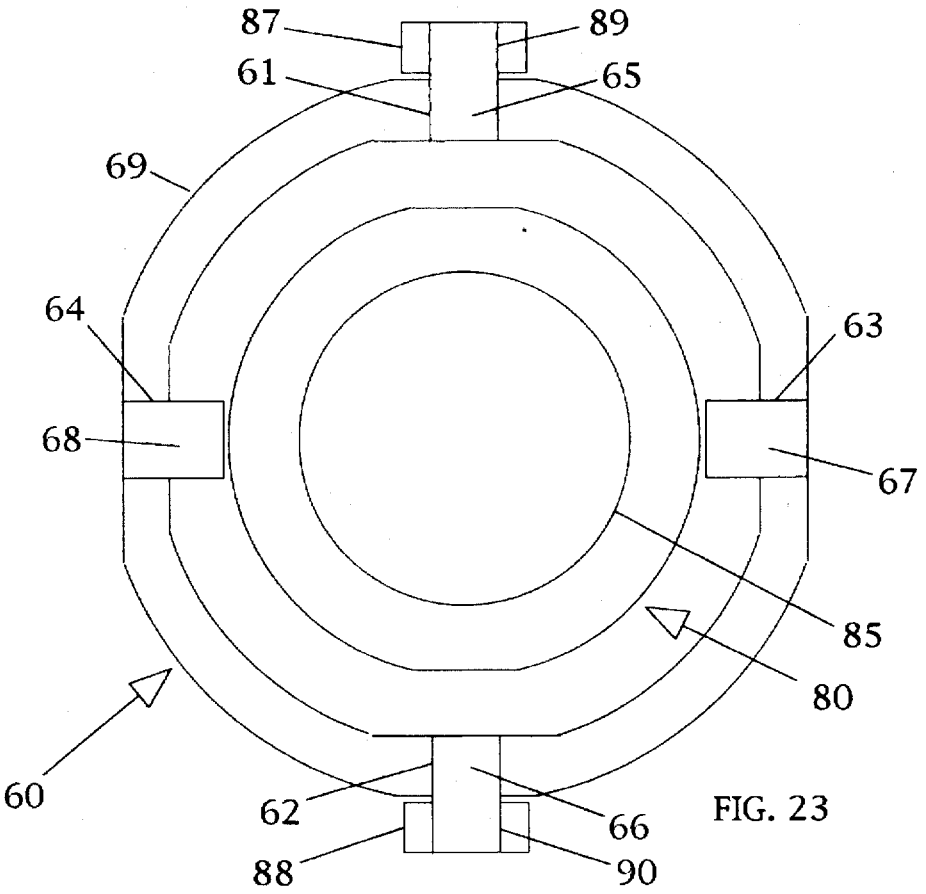
FIG. 23 is an end view of the version of the invention of FIG. 22 along the 23—23 lines.
Figure 22:
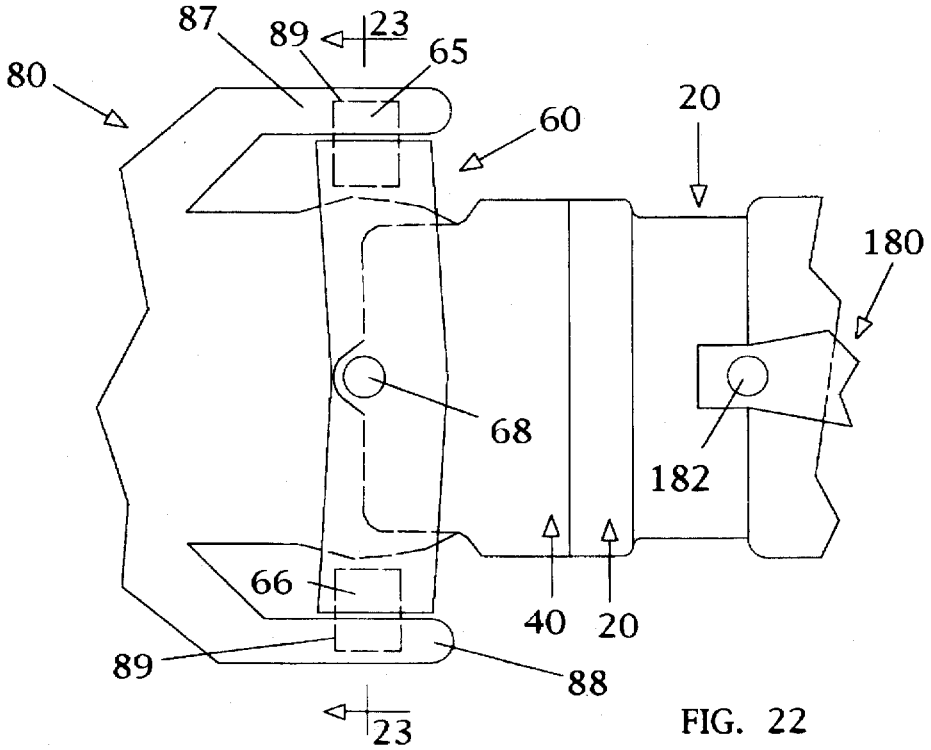
FIG. 22 is a side view of a portion of the bowl adapter and the control collar, showing how these elements are attached in the preferred embodiment.

Two similar species of the bowl adapter are disclosed. The preferred species, seen in FIGS. 22 and 23 provides a tapered body 86 having a forward opening 84 which attaches to the impeller bowl 262 and a rearward opening 85 about which the nozzle front lock plate pivots. The bowl adapter 80 is typically made of aluminum, to withstand the water pressure involved. The two species differ in the structures used to connect the bowl adapter 80 to the control collar 60. As seen in FIGS. 22 and 23, an upper ear 87 and a lower ear 88 each provide a pin hole 89 sized to fit the upper and lower pins 65, 66 of the control collar 60.

As seen in the cross-sectional view of FIG. 7 and in end-view in FIG. 8, the second version of the bowl adapter provides slightly different structures by which the bowl adapter is connected to the control collar 60. As seen in FIGS. 7 and 8, the bowl adapter 80 provides an upper pin hole 81 and a lower pin hole 82, for attachment to the control collar 60.

As seen in particular in FIGS. 7, 8, 22, and 23 a control collar 60 is pivotally attached to the bowl adapter by means of an upper pin 65 and a lower pin 66. The control collar 60 has an annular body 69 having an inside diameter that is larger than the outside diameter of the rearward opening 85 of the bowl adapter 80. The body 69 of the control collar provides upper and lower pin holes 61, 62, on a vertical axis, and left and right pin holes 63, 64 on a horizontal axis. The left and right pin holes 63, 64 carry left and right pins 67, 68. The upper and lower pin holes 61, 62 carry upper and lower pins 65, 66.

As seen in FIGS. 22 and 23, in the preferred embodiment upper pin 65 is carried by upper pin hole 61 of the control collar 60 and by hole 89 in the upper ear 87 of the bowl adapter 80. The lower pin 66 is carried by lower pin hole 62 of the control collar and by hole 90 in the lower ear 88 of the bowl adapter. Together, pins 65, 66 allow the control collar to pivot about a vertical axis with respect to the bowl adapter.

In an alternative embodiment of the invention seen in FIGS. 7 and 8, upper pin 65, carried by upper pin holes 61, 81, of the control collar 60 and the bowl adapter 80 and lower pin 66, carried by lower pin holes 62, 82, of the control collar and the bowl adapter, allow the control collar to pivot about a vertical axis with respect to the bowl adapter. In a typical application using either embodiment, the control collar 60 is allowed to rotate through a range of approximately 70 degrees with respect to the bowl adapter 80.

As seen in particular in FIGS. 4, 6, 7, 26 and 27 a nozzle front lock plate 40 is seen. The annular body 41 of the lock plate 40 provides an axial channel 49 which allows water to flow from the interior channel 83 of the bowl adapter 80 to the water flow channel 27 of the nozzle housing 20. An annular rim 44 connects the nozzle front lock plate 40 to an attachment rim 30 of the nozzle housing 20.

FIG. 6 is a top view showing the method by which the left and right attachment ears 45, 46, each having a pin hole 47, of the nozzle front lock plate 40 are pivotally attached to the control collar 60 by means of left and right pins 67, 68. In a typical application, the nozzle front lock plate 40 (and therefore the attached nozzle housing 20) is allowed to rotate through a range of approximately 40 degrees in the vertical plane. FIG. 7 shows in dotted outline the right attachment ear 46, and illustrates how the vertical rotation about the horizontal axis of pins 67, 68 does not interfere with the horizontal rotation about the vertical axis of pins 65, 66.

Figure 26:
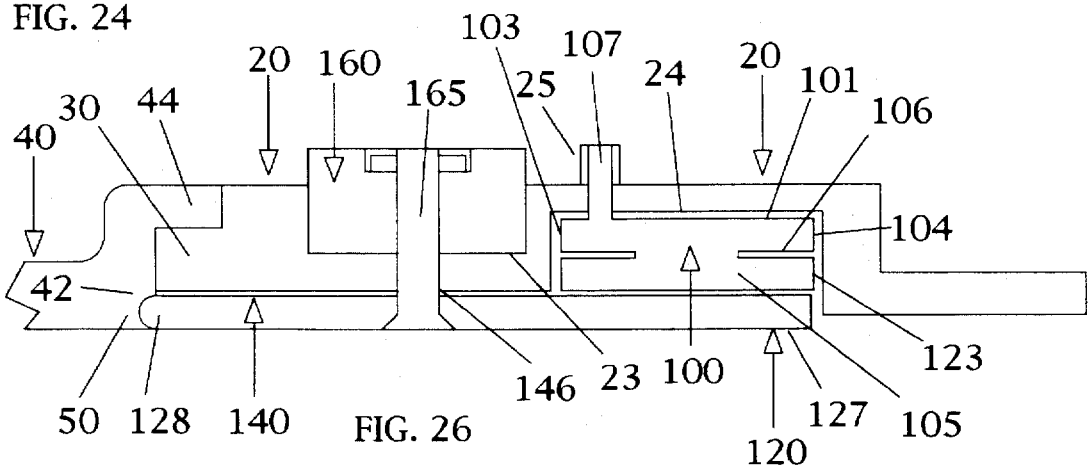
FIG. 26 is a side view of one nozzle cone plate, the annular elastic bladder, and the elastic block in a preferred embodiment.

The preferred version of the invention is seen in FIGS. 26 ad 27, and provides a rounded socket which carried the nozzle cone plates 120.

Figure 9:
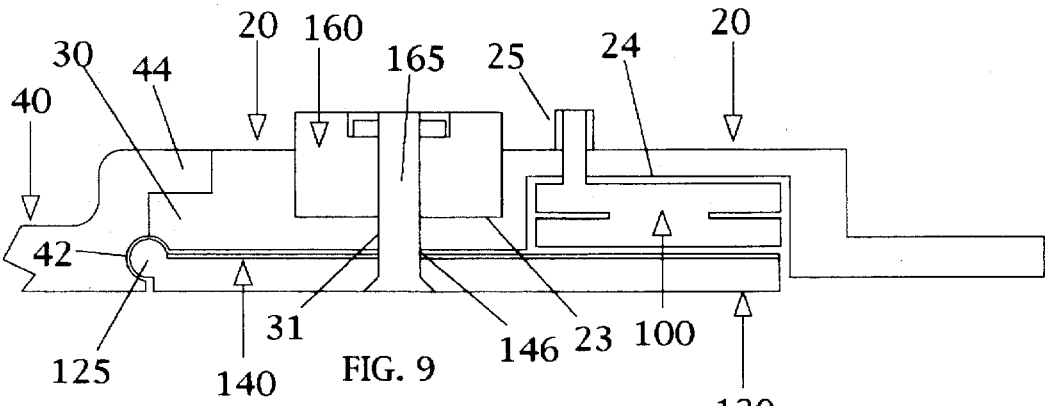
FIG. 9 is a lengthwise cross-sectional view of a portion of the nozzle of a version of the invention having cone shield plates where the nozzle cone plates and cone shield plates are in the open position, showing the attachment of a nozzle cone plate.

In a second version of the invention, the body 41 of the nozzle front lock plate 40 provides four similar cone pivot recesses 42, as seen in FIG. 9, sized incrementally larger than the cylindrical tab 125 of the nozzle cone plates 120.

As seen in particular in FIGS. 6, 7, 9, and 10, a generally cylindrical nozzle housing 20 having a forward opening 28 and a rearward opening 29 is attached to the nozzle front lock plate 40 by means of bolts or other connectors which join attachment rim 30 of the nozzle housing 20 to attachment rim 44 of the nozzle front lock plate 40. A water flow channel 27 is provided, and allows water to flow from the axial channel 49 of the nozzle front lock plate 40.

In the preferred embodiment, four cone pivot recesses 21, one associated with each nozzle cone plate 120 are positioned adjacent to the cone pivot recesses 42 of the nozzle front lock plate 40, and allow the joined nozzle housing 20 and nozzle front lock plate 40 to trap the cylindrical tab 125 of the nozzle cone plates 120 between the recesses 42, 21. A smaller shield pivot recess 22 is sized incrementally larger than the cylindrical tab 145 of the cone shield plates 140.

Figure 10:
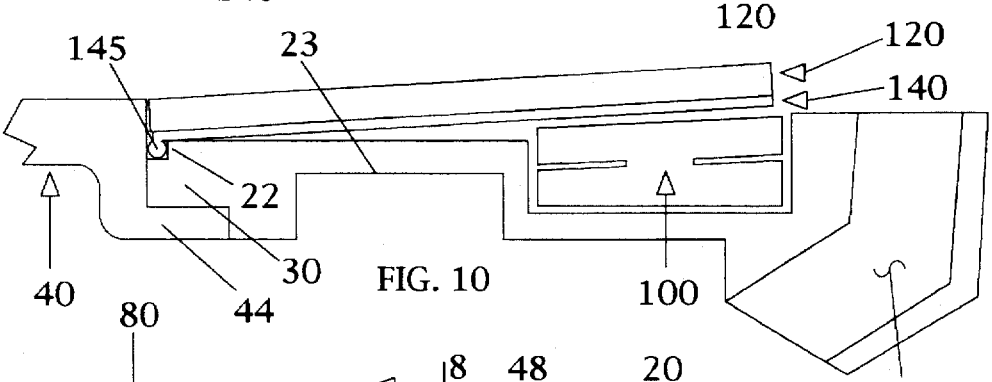
FIG. 10 is a lengthwise cross-sectional view of a portion of the nozzle of FIG. 9 where the nozzle cone plates and cone shield plates are in the closed position, showing the attachment of a cone shield plate.

As seen in FIGS. 9 and 10, the nozzle housing 20 provides one elastic block recess 23 for each nozzle cone plate 120. A bolt hole 31 is provided in each elastic block recess of the housing 20, to allow a bolt 165 to attach the elastic block 160 to the nozzle housing 20 and to the nozzle cone plates 120. An annular bladder recess 24 is sized to support the elastic annular bladder 100, and is located in the rearward interior portion of nozzle housing 20. A fill port hole 25 provides a passageway for the hydraulic hose connected to the annular bladder 100. A reverse passage 26 allows water to be expelled under pressure when the reverse bucket is covering the end of the nozzle. The reverse passage is generally pointed rearward and downward, as seen in FIG. 7.

Referring to FIGS. 9, 10, 11, and 12, four nozzle cone plates 120 are seen. The nozzle cone plates 120 are movable within the nozzle housing 20 between a "closed" position and an "open" position. In the "closed" position, the side edge surfaces 124 of each nozzle cone plate are in contact with the side edge surfaces of adjacent cone plates and the cross-sectional area of the water passageway 27 through the nozzle is smaller than in the "open" position. In the "open" position the nozzle cone plates 120 are spread radially outwardly, and the side edge surfaces 124 of each nozzle cone plate are not in contact with the side edge surfaces of adjacent cone plates. Each nozzle cone plate provides a concave inside surface 121 and a convex outside surface 122. An end edge surface 123 is seen particularly in FIG. 11. The nozzle cone plates 120 are typically of approximately ¼ inch thick aluminum construction, but may be made of other materials or thicknesses.

Figure 27:
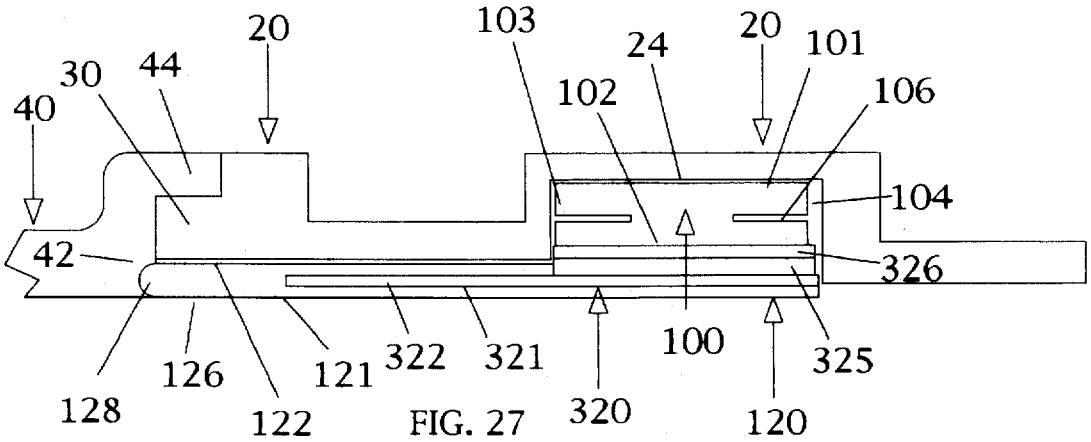
FIG. 27 is a view of the version of the invention seen in FIG. 26 rotated 45 degrees, where the elastic block is rotated out of view and a spline assembly is in view.

In a preferred species of the invention, as seen in FIGS. 26 and 27, the forward portion 126 of each nozzle cone plate 120 provides a rounded end 128, that allows the nozzle cone plate to pivot between the open and closed positions. The rounded end 128 rotates in the rounded socket 50 of the nozzle front lock plate 40, or may rotate in a similar socket that is part of the nozzle housing 20.

In a second species of the invention, as seen in FIG. 9 the forward portion 126 of each plate 120 is attached to the nozzle housing 20 and the nozzle front lock plate 40 by means of cylindrical tab 125, while the rearward portion 127 of each plate 120 is in contact with elastic annular bladder 100. The cylindrical tab 125 is pivotally carried in a cylindrical recess formed by the combined area between the cone pivot recess 21 of the nozzle housing 20 and the cone pivot recess 42 of the nozzle front lock plate 40. The nozzle cone plates 120 rotate on the cylindrical tab 125, as seen by comparison of FIGS. 9 and 10.

Figure 13:
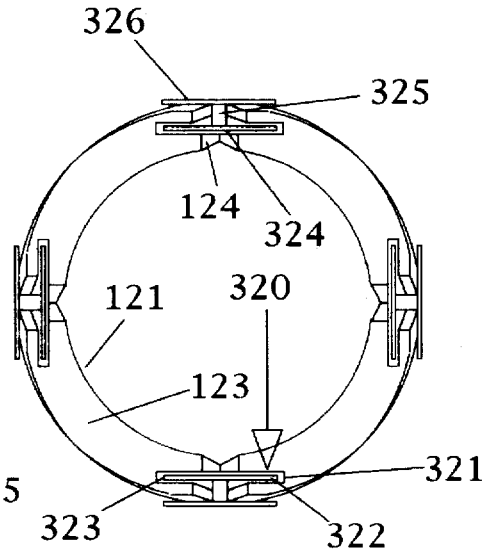
FIG. 13 is a cross-sectional view of a primary version of the invention having a locking splines assembly, showing the nozzle with the nozzle cone plates in the open position, with the nozzle housing and nozzle front lock plate removed for clarity.
Figure 14:
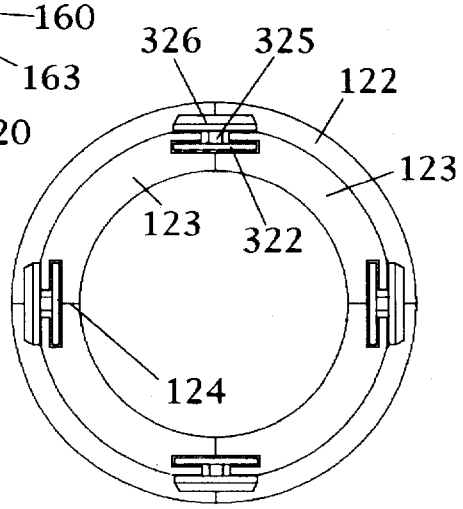
FIG. 14 is a cross-sectional view of the version of the invention seen in FIG. 13 having a locking splines assembly, showing the nozzle with the nozzle cone plates in the closed position, with the nozzle housing and nozzle front lock plate removed for clarity.

The preferred version of the invention provides a locking splines assembly 320, as seen in FIGS. 13 through 15 to force the nozzle cone plates 120 to act in a symmetrical manner and to bridge the gap between adjacent nozzle cone plates when the nozzle is in its open state. Bridging the gap between adjacent nozzle cone plates, during the open state of the nozzle, prevents the elastic annular bladder 100 from entering that gap. Similarly, a second version of the invention better suited for lower horsepower applications, provides cone shield plates to perform the same functionality. In both versions of the invention, the structures disclosed provide a means by which the nozzle cone plates are aligned in a symmetrical manner during operation. Without such structures, it is possible that one of the nozzle cone plates could move into the water flow channel 27 while the other plates were more radially distant fro the flow channel. This could cause jamming, binding, and increased water resistance. Similarly, both versions of the invention provide structures which prevent any part of the elastic annular bladder 100 from moving to a position between the side edge surfaces 124 of adjacent nozzle cone plates 120. These structures tend to bridge the gap between adjacent nozzle cone plates.

Figure 24:
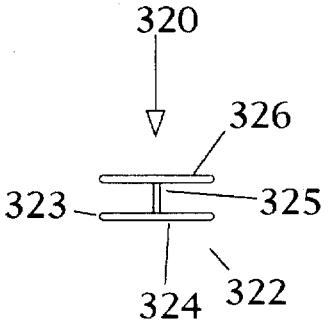
FIG. 24 is an end view of the spline of FIG. 25, taken on the 25—25 lines.
Figure 25:
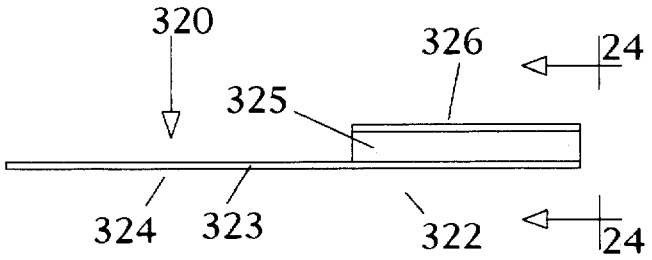
FIG. 25 is a side view of the splines of the preferred version of the invention.

As seen in FIGS. 13–15, a locking splines assembly 320 provides a number of splines 322 equal to the number of nozzle cone plates 120, and connects the adjacent sides of adjacent nozzle cone plates 120. FIG. 13 shows the locking splines 322 when the nozzle cone plates 120 are in the "open" position, while FIG. 14 shows the locking splines 322 when the nozzle cone plates in the "closed" position. The purpose of the locking splines assembly is to keep the nozzle cone plates 120 in the position seen in either FIG. 13 or 14; i.e. to prevent one or more of the nozzle cone plates from moving into the water flow channel 27 or acting inconsistently with the other nozzle cone plates. The locking splines assembly 320 provides a spline cavity 321 in each side edge surface 124 of each nozzle cone plate 120. As seen in FIGS. 24 and 25, each spline 322 provides a sheet-like face 324 with peripheral edge surfaces 323 that is carried by the spline cavity 321 of two adjacent nozzle cone plates 120. A connector 325 is perpendicular to the spline face 324. The length of the connector 325 is determined by the distance from the spline cavity 321 in a nozzle cone plate to the outside surface 122 of that nozzle cone plate. A spline shield 326 is carried by connector 325 on the outside surfaces 122 of two adjacent nozzle cone plates 120, and protects bladder 100.

Lower horsepower applications may replace the splines assembly 320 with a number of cone shield plates 140 equal to the number of nozzle cone plates 120. Referring to FIGS. 9 to 12, four cone shield plates 140 are seen. The cone shield plates 140 are similar in structure to the nozzle cone plates, each plate having a concave inside surface 141, a convex outside surface 142, an end edge surface 143, and a side edge surface 144. As seen in FIGS. 9 through 12, the inside surface 141 of each cone shield plate 140 is adjacent to the outside surface 122 of two adjacent nozzle plates 120. The cone shield plates 140 are attached to the nozzle housing 20 by means of a cylindrical tab 145 that is carried by a shield pivot recess 125 in the nozzle housing. The cylindrical tab 145 is similar to the cylindrical tab 125 of the nozzle cone plates, but is typically smaller in size.

As seen in FIGS. 15 and 16, an alternate version of the invention attaches the forward edge of the cone shield plates 140 to the forward portion of the nozzle cone plates 120.

The function of the cone shield plates 140 is to prevent the elastic annular bladder 100 from moving into the areas between the side edge surfaces 124 of the nozzle cone plates when the nozzle cone plates are in the "open" state. Because the cone shield plates 140 are offset 45 degrees from the nozzle cone plates, when the nozzle cone plates are in the "open" state, each cone shield plate bridges the gap between the side edge surfaces 124 of two adjacent nozzle cone plates.

Each cone shield plate 140 provides two half-circle notches 146 that allow two adjacent cone shield plates to close about the bolt 165 holding a nozzle cone plate to an elastic block 160.

Figure 12:
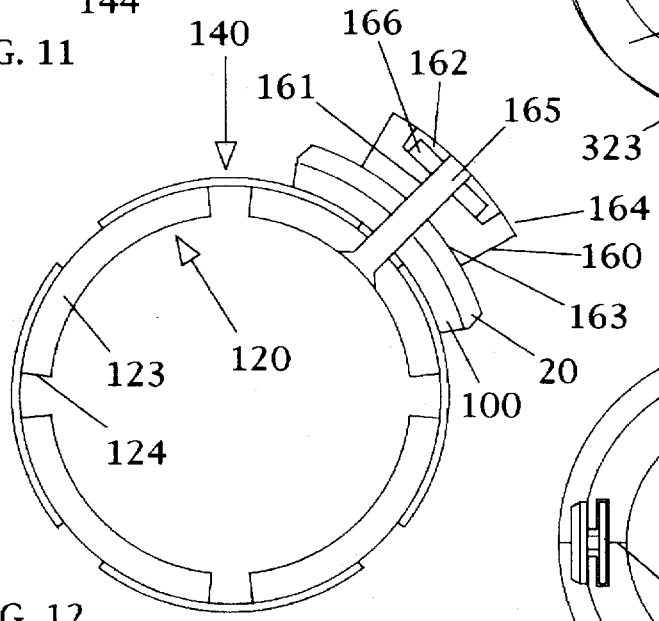
FIG. 12 is a cross-sectional view of a version of the nozzle with the nozzle cone plates and cone shield plates in the open position, showing only a portion of the nozzle housing, annular bladder, and one elastic block for clarity.

The variable diameter jet propulsion unit of the invention provides a biasing structure to bias the nozzle cone plates 120 radially outwardly. This biasing force is weaker than the radially inward force of the elastic annular bladder 100, but can compress and empty the bladder when the bladder is not being provided with pressurized hydraulic medium. As seen in FIGS. 9 and 12, the radially outwardly biasing structure of the preferred embodiment of the invention provides an elastic block 160 associated with each nozzle cone plate 120. Other structures, such as springs, may be used to replace the elastic block. Elastic block 160 would be in its compressed state in when the nozzle cone plates are in the position depicted in FIG. 1 0, and the elastic block would be in it relaxed state when the nozzle cone plates are positioned as seen in FIG. 9. This is because radially inward movement of the nozzle cone plates compresses the elastic block. The outer surface 164 of each elastic block 160 is attached to a nozzle cone plate 120 by means of a bolt 165 and nut 166 or other fastener. As seen in FIG. 9, the inner surface 163 of an elastic block 160 rests on the elastic block recess 23 of the nozzle housing 20. Each elastic block provides a bolt hole 161 through the block and a recessed area 162 in outer surface 164 for the nut 166.

As seen in FIGS. 6, 9, 10, 17 and 18, an elastic annular bladder 100 is seen. The elastic annular bladder 100, powered by an hydraulic power source, is capable of constricting the nozzle cone plates 120 from the position seen in FIGS. 9 and 12 to the position seen in FIGS. 10 and 11 even where hundreds of horsepower are being used to send water through water flow channels 83, 49, 27 of the bowl adapter 80, the nozzle front lock plate 40, and the nozzle housing 20. The elastic annular bladder provides an inside wall 101, an outside wall 102, and forward and rearward end walls 103, 104, surrounding a fluid chamber 105. Optionally, accordion folds 106 could be used to allow the elastic annular bladder 100 to be made of a less elastic material. A fill port 107 allows fluid to enter and leave the bladder 100.

Referring to the diagrams of FIGS. 19–21, it is seen that the preferred version of the invention supplies water from the bowl adapter 80 as the hydraulic medium of the elastic annular bladder 100, as well as for operation of the reverse bucket and for trimming the nozzle. As seen in FIG. 21, an accumulator 400 is supplied with water from the bowl adapter 80. A cyclonic filter 404 removes impurities. Air is removed by means of air bleed 401. An auxiliary pump 403, controlled by switch 359 allows the user to pressurize the accumulator 400 when the engine of the boat is off.

Pressure from the larger diameter end of the bowl adapter 80 and the accumulator 400 is greater than the pressure of water moving through the nozzle, thereby allowing bladder 100 to overcome resistance to closing the nozzle created by the water flowing through channel 27. The ratio of the area of contact between the bladder 100 and the area of the nozzle cone plates exposed to fluid flow in channel 27 must be chosen so that the bladder is able to overcome the force of the fluid in the channel. Thus, a greater percentage of the area of the outside surface 122 of the nozzle cone plates 120 in contact with the bladder would aid the bladder 100 in forcing the nozzle cone plates into the closed position.

Referring in particular to FIG. 19, the control valve assembly 350 is seen. Rocker switch 351 controls pressurizing solenoid valve 352 and bleeding solenoid valves 353 associated with hydraulic line 354 associated with a first cylinder of a double acting cylinder 405 associated with trim control. Rocker switch 351 also controls pressurizing solenoid valve 363 and bleeding solenoid valves 364 associated with hydraulic line 355 associated with a second cylinder of the double acting cylinder 405. Rocker switch 369 controls pressurizing solenoid valve 365 and bleeding solenoid valves 366 associated with hydraulic line 356 associated with a single acting cylinder 406 associated with the reverse bucket. Rocker switch 349 controls pressurizing solenoid valve 367 and bleeding solenoid valves 368 associated with hydraulic line 357 associated with the elastic annular bladder 100.

The user may control the amount of fluid sent to the bladder 100, and therefore may fine-tune the size of the nozzle opening by either of several systems. First, by carefully controlling the electrical switch 349 controlling the pressurizing and bleeding solenoids 367, 368, the user may send more of less fluid to the bladder 100. Alternatively, the preferred embodiment of the invention provides that the switch be controlled by well-known microprocessor based electronics. A further alternative system, seen in FIG. 20, provides a mechanical nozzle size setting apparatus 370 that allows the user to choose between bladder full, bladder empty, and four intermediate settings. Two interconnected pistons, one piston moving inside a first cylinder 371 and one piston moving inside a second cylinders 372, move in response to fluid entering the first cylinder from line 357. By reducing the diameter of the second piston and cylinder, a mechanical advantage may be achieved, if desired. Switches 373, 374 are activated by piston movement in the first and second cylinders, and stop the flow of fluid when either cylinder is full. Intermediate position switch actuators 375, which activate intermediate position switches 362, which in turn control relays 360, control solenoid valves 367, 368. Thus activation of rocker switch 349, attached to nozzle setting apparatus 370 would result in movement of the piston in the connected cylinders 371, 372 by one notch of contacts 375. Movement of fluid in line 357 going into the first cylinder 371 would result in fluid leaving the second cylinder 372 by means of line 358. Similarly, fluid returning from the bladder in line 358 would result in fluid being moved from cylinder 371, through valve 368, and out bleed line 402 into the lake or ocean.

Figure 3:
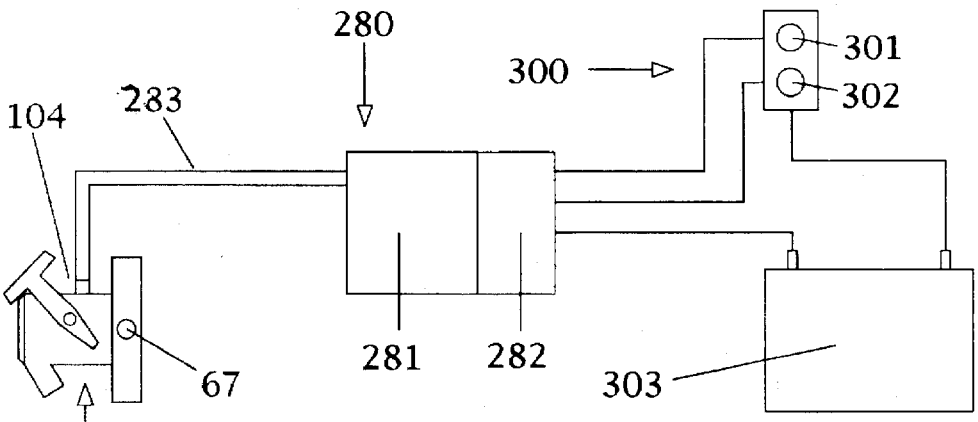
FIG. 3 is a diagrammatic view of the adjustable diameter nozzle of the invention and hydraulic equipment associated with a second species of the invention.
Figure 5:
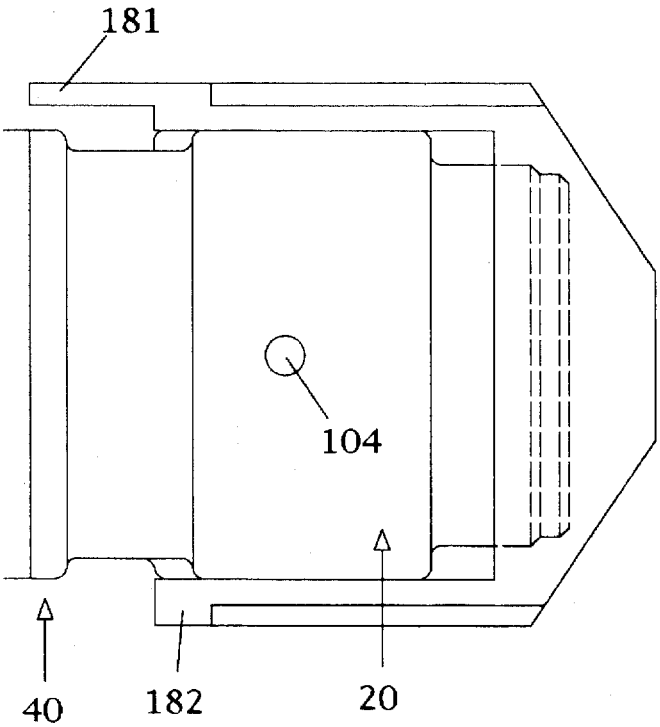
FIG. 5 is a top view of the rear portion of the nozzle, with the reverse bucket in the position required for its use.
Figure 4:
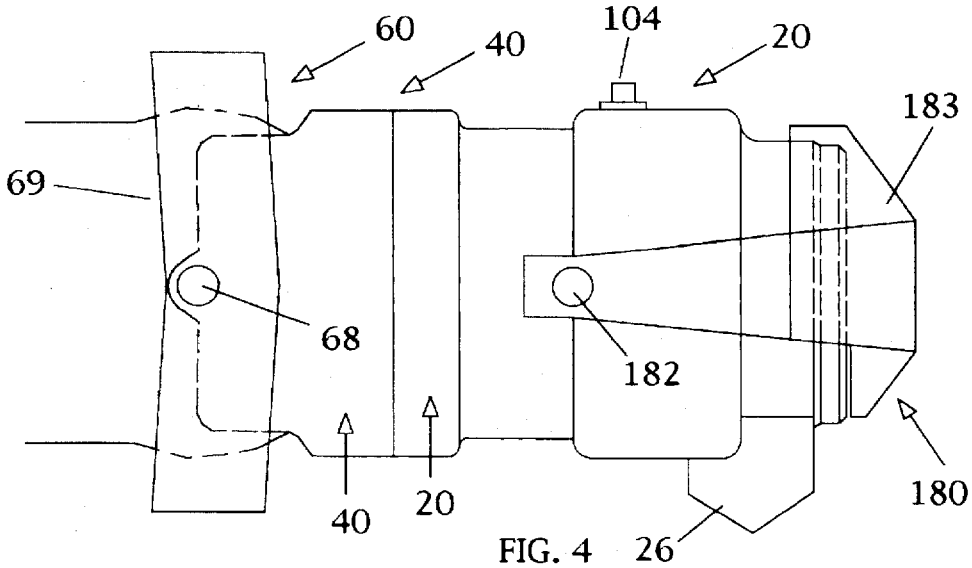
FIG. 4 is a side view of the nozzle of a version of the invention.

An alternative version of the invention provides hydraulic medium to the elastic annular bladder 100 by means of the hydraulic assembly 280 seen in diagrammatic form in FIG. 3. In this embodiment of the invention, fluid is pumped into and out of bladder 100 by means of a hydraulic hose 283 connected to a pressure and volume pump 281 that is driven by electric pumping motor 282. Pumping motor 282 is activated by a switch assembly 300 having an open switch 302 and a close switch 301 attached to a first terminal of a battery 303. The open switch 302 causes fluid to be removed from the elastic annular bladder 100, while the close switch 301 tends to close the nozzle by moving fluid into the elastic annular bladder. A return wire connects the motor to the second battery terminal. A variety of alternative wiring arrangements would be possible, depending on the requirements of the motor and the type of switching assembly used.

The elastic annular bladder 100 replaces the cylinders used in many hydraulic applications. As a result, it is not necessary to use standard hydraulic fluid in the elastic annular bladder 100, although standard hydraulic fluid may be used. Alternatively, the fluid used may be water from the impeller bowl 262 sufficiently amplified in pressure by known hydraulic technology. Alternatively, other mediums including, but not limited to, oil, viscous gelatins or various slurries may be used. The choice of fluid should be made with regard to the advantages certain fluids have in dampening the harmonic oscillations caused by the jet pump, the pump housing, the impeller bowl design, or interior surface finishes.

To use the variable diameter jet propulsion unit of the invention, an existing jet boat may be modified in accordance with the preceding disclosure, or a new boat created. If a new boat is created, the impeller bowl 262 may be designed to eliminate the need for a bowl adapter 80. The operator of the boat operates the throttle and steering controls in the normal manner, and with the normal result.

With the boat's engine off, pressure may be built in accumulator 400 by activating pump 403 with switch 359. Alternatively, the boat's engine may be turned on. Operation of switch 351 controls solenoid valves 352, 353, 363, and 364, sending fluid through line 354 or 355 and causing fluid to be discharged from the other line into discharge line 402. Fluid moving in this manner causes double acting cylinder 405 to operate the trim control assembly 220. Similarly, the operation of switch 369 controls solenoid valves 365, 366, sending fluid into or out of line 356, operating trim control cylinder 406.

The diameter of the nozzle formed by nozzle cone plates 120 is controlled by using switch 349. If a microprocessor control system is used, that control system would operate solenoids 367, 368 to send water from the accumulator 400 into the elastic annular bladder 100, and out of that bladder through line 402 into the ocean. The user would then determine the correct nozzle position: open, closed or some intermediate position.

The open position is typically used for more rapid acceleration, and causes a greater quantity of somewhat more slowly moving water to exit from the water flow channel 27. The closed position is typically used for reaching a greater top speed, and causes a smaller quantity of somewhat faster moving water to exit from the water flow channel 27. Intermediate positions would result in intermediate results, and may be chosen to maximize fuel economy. Therefore, in use, the operator typically closes the diameter of the variable jet propulsion unit as the speed of the vessel increases. Alternatively, if a fuel economy gauge is available, the operator may achieve a desired speed, and then regulate the variable diameter jet propulsion unit until the fuel economy gauge is maximized.

It is therefore a primary advantage of the present invention to provide a novel hydraulically operated device to control the cross-sectional area of the jet propulsion nozzle so that the operator may maximize the output of the jet for more rapid acceleration, greater top speed, or other factors. The device must function even where the propulsion unit has almost unlimited horsepower.

Another advantage of the present invention is to provide a device to control the cross-sectional area of a jet boat's nozzle that is capable of being installed on existing jet boats.

A further advantage of the present invention is to provide a device to control the cross-sectional area of a jet boat's nozzle that is compatible with, and downstream from, any steering and trim mechanisms. Significantly, the nozzle does not result in an energy consuming stream deformation. The nozzle of the present invention is advantageous in that it does not depend on rigid mechanical linkages that would interfere with movement in the vertical or lateral planes and would contribute an absolute minimum to water resistance.

A still further advantage of the present invention is to provide a device to control the cross-sectional area of a jet boat's nozzle that is external to the boat's pumping unit for ease of maintenance.

A still further advantage of the present invention is to provide a variable diameter jet propulsion unit for marine crafts of all sizes, from jet skis to the largest commercial or military vessel.

Although the present invention has been described in considerable detail and with reference to certain preferred versions, other versions are possible. For example, while a preferred version of the invention provides structures including an elastic block to bias the nozzle cone plates radially outwardly, alternative structures, such as springs, would be within the scope of the invention. Also, while the preferred version of the invention provides a locking splines assembly to force the nozzle cone plates to act in a symmetrical manner and to bridge gaps between adjacent nozzle cone plates, and a second structure was disclosed using cone shield plates that would function in a similar manner, other structures are possible, and would be within the scope of the invention. Additionally, while the preferred embodiment provides four nozzle cone plates, a greater or lesser number could be used, if desired. Similarly, while the elastic annular bladder is the preferred structure, a less effective alternative might include the use of a plurality of disjoint bladders. Also, while the disclosure provides for the use of a bowl adapter, it is clear that if the boat were manufactured originally with the intent of practicing the instant invention, the impeller bowl 262 could be modified to perform the function of the bowl adapter. And, while the preferred embodiment of the invention provided both a nozzle housing and a nozzle front lock plate, these components could be integrated, if desired, into a unified component. Therefore, the spirit and scope of the appended claims should not be limited to the description of the preferred versions disclosed here.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A variable diameter jet propulsion unit for a marine craft, comprising:

(a) a nozzle housing, defining an annular bladder recess;

(b) at least three nozzle cone plates, pivotally mounted within the nozzle housing;

(c) an annular bladder, carrried by the bladder recess and in contact with the nozzle cone plates; and (d) a source of hydraulic power, attached to the annular bladder.

2. The apparatus of claim 1, further comprising means for using hydraulic power from, an impeller bowl portion of the jet propulsion unit to control the annular bladder.

3. The apparatus of claim 1, further comprising:

(a) nozzle cone plate alignment means for keeping the cone plates in a symmetrical relationship.

4. The apparatus of claim 2, further comprising a control collar, pivotally mounted to the bowl adapter.

5. The apparatus of claim 4, further comprising a nozzle front lock plate, pivotally mounted to the control collar and attached to the nozzle housing.

6. The apparatus of claim 1, further comprising:

(a) biasing means for biasing the nozzle cone plates radially outwardly.

7. The apparatus of claim 2, further comprising:

(a) nozzle cone plate alignment means for keeping the cone plates in a symmetrical relationship.

8. A variable diameter jet propulsion unit for a marine craft, comprising:

(A) a nozzle housing;

(B) at least three nozzle cone plates, pivotally mounted to the nozzle housing, each nozzle cone plate having two side edges, each side edge having a spline cavity;

(C) an annular bladder, carrried by the nozzle housing and in contact with the nozzle cone plates;

(D) a source of hydraulic power, attached to the annular bladder; and (E) nozzle cone plate alignment means for keeping the cone plates in a symmetrical relationship, comprising: at least three splines, each spline carried by one spline cavity in each of two adjacent nozzle cone plates.

9. A variable diameter jet propulsion unit for a marine craft, comprising:

(A) a nozzle housing;

(B) at least three nozzle cone plates, pivotally mounted to the nozzle housing, each nozzle cone plate having two side edges, each side edge having a spline cavity;

(C) an annular bladder, carried by the nozzle housing and in contact with the nozzle cone plates;

(D) a source of hydraulic power, attached to the annular bladder; and (E) nozzle cone plate alignment means for keeping the cone plates in a symmetrical relationship, comprising:

(a) at least three cone shield plates, pivotally mounted to the nozzle housing, in a manner that is staggered from the nozzle cone plates.

10. A variable diameter jet propulsion unit for a marine craft, comprising:

(a) a nozzle housing;

(b) at least three nozzle cone plates, pivotally mounted to the nozzle housing;

(c) an annular bladder, carried by the nozzle housing and in contact with the nozzle cone plates;

(d) a source of hydraulic power, attached to the annular bladder; and (e) biasing means for biasing the nozzle cone plates radially outwardly, comprising a plurality of elastic blocks, each block carried by a nozzle cone plate and by the nozzle housing.

11. A variable diameter jet propulsion unit for a marine craft, comprising:

(a) a nozzle housing;

(b) at least three nozzle cone plates, pivotally mounted to the nozzle housing;

(c) an annular bladder, carried by the nozzle housing and in contact with the nozzle cone plate;

(d) a source of hydraulic power, attached to the annular bladder; and (e) bridge means for preventing any part of the elastic annular bladder from moving into an area between two nozzle cone plates.

12. The apparatus of claim 11, which the bridge means comprises:

(a) a spline shield carried by a spline.

13. An apparatus to alter the cross-sectional area of the nozzle of a jet propulsion unit of a marine craft having an impeller bowl, comprising:

(a) a bowl adapter, attached to the impeller bowl of a jet boat;

(b) a control collar, pivotably attached to the bowl adapted;

(c) a nozzle front lock plate, pivotably attached to the control collar;

(d) a nozzle housing, attached to the nozzle front lock plate, having an annular bladder recess;

(e) at least three nozzle cone plates, each nozzle cone plate having two side edge surfaces, each nozzle cone plate pivotally mounted to the nozzle housing and the nozzle front lock plate;

(f) nozzle cone plate alignment means for keeping the cone plates in a symmetrical relationship;

(g) an elastic annular bladder, carried by the annular bladder recess, surrounding and in contact with the cone shield plates and the nozzle cone plates;

(h) bridge means for preventing any part of the elastic annular bladder from moving into an area between the side edge surfaces of two adjacent nozzle cone plates;

(i) a source of hydraulic power attached to the annular bladder; and (j) biasing means for biasing the nozzle cone plates radially outwardly.

14. The apparatus of claim 13, in which the nozzle cone plate alignment means comprises:

(a) a splines assembly, carried by the nozzle cone plates.

15. The apparatus of claim 13, which the nozzle cone plate alignment means comprises:

(a) cone shield plates, carried radially outwardly of the nozzle cone plates and in a staggered relationship to the nozzle cone plates.

16. The apparatus of claim 13, which the bridge means comprises:

(a) a spline shield, carried by a spline.

17. The apparatus of claim 13, in which the biasing means comprises:

(a) a plurality of elastic blocks, each block carried by a nozzle cone plate and by the nozzle housing.

18. The apparatus of claim 13, in which the source of hydraulic power comprises the impeller bowl, pressurized water contained in the impeller bowl, and the jet propulsion unit of a marine craft.

19. The apparatus of claim 13, in which the source of hydraulic power comprises an hydraulic pump.

* * * * *